US006771911B2

(12) United States Patent
Ko

(10) Patent No.: US 6,771,911 B2
(45) Date of Patent: Aug. 3, 2004

(54) APPARATUS FOR AND METHOD OF CONTROLLING TONER DENSITY

(75) Inventor: Chang-kyung Ko, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/298,580

(22) Filed: Nov. 19, 2002

(65) Prior Publication Data

US 2003/0118358 A1 Jun. 26, 2003

(30) Foreign Application Priority Data

Dec. 26, 2001 (KR) ..... 2001-85316

(51) Int. Cl.[7] ..... G03G 15/00; G03G 15/08

(52) U.S. Cl. ..... 399/27; 399/49; 399/260

(58) Field of Search ..... 399/27, 30, 58, 399/60, 61, 260, 258; 222/DIG. 1

(56) References Cited

U.S. PATENT DOCUMENTS 5,353,102 A * 10/1994 Sato et al. ..... 399/30
5,867,198 A * 2/1999 Gwaltney et al. ..... 399/27 X
5,887,221 A * 3/1999 Grace ..... 399/49
6,374,064 B1 * 4/2002 Budnik et al. ..... 399/27

FOREIGN PATENT DOCUMENTS

JP 09-114212 * 5/1997

* cited by examiner

*Primary Examiner*—Sophia S. Chen
(74) *Attorney, Agent, or Firm*—Staas & Halsey LLP

(57) ABSTRACT

An apparatus for controlling a toner density accurately in response to printing data include a toner sensor, a memory, a data input unit, a toner supply amount controlling unit, and a CPU. The toner sensor detects the toner density and generates a toner density detection value. The memory stores a toner density set-up value and an operational constant data table having an operational constant corresponding to the printing data. The toner supply amount controlling unit supplies the toner in response to a control signal generated from the CPU. The CPU determines the operational constant by using the operational constant data table, and controls the toner supply amount controlling unit by using the control signal generated from the operational constant, the toner density detection value, and the toner density set-up value.

20 Claims, 4 Drawing Sheets

APPARATUS FOR AND METHOD OF CONTROLLING TONER DENSITY

CROSS-REFERENCE TO RELATED APPLICATIONS

This application claims the benefit of Korean Patent Application No. 2001-85316, filed Dec. 26, 2001, in the Korean Intellectual Property Office, the disclosure of which is incorporated herein by reference.

BACKGROUND OF THE INVENTION

1. Field of the Invention

The present invention relates to an apparatus for and a method of controlling a supplying amount of toner, and more particularly, to an apparatus for and a method of accurately controlling a mixing rate of toner and a carrier in accordance with an amount of printing data.

2. Description of the Related Art

A conventional image recording apparatus, such as a laser printer, a printer having a LPH (LED Print Head), or a PP (Plain Paper) facsimile uses an electrophotography developing method.

There are two types of developing methods to allow toner to stick to an electrostatic latent image formed on a photosensitive medium: a one ingredient developing method and a two ingredient developing method. The one ingredient developing method uses the toner only as a one ingredient developing agent, and the two ingredient developing method uses mixed toner and a carrier as a two ingredients developing agent. The image recording apparatus using the electrophotography developing method employs the two ingredients developing method. In the two ingredients developing method, the toner and the carrier are mixed in a predetermined proportion to form the two ingredients developing agent and to send the toner to the electrostatic latent image of the photosensitive medium. Hereinafter, the two ingredients developing agent having mixed toner and the carrier in the predetermined proportion will be referred to as a developing agent. The carrier is a medium to cause the toner to stick to the electrostatic latent image of the photosensitive medium. Ferrous ferrite can be used as the carrier.

It is very important to control a toner density to obtain a good quality of a printing image in the two ingredients developing method unlike the one ingredient developing method. While an amount of the toner is controlled because only the toner is used in the one ingredient developing method, each proportion of the toner and the carrier, in other words, the toner density should be controlled in the two ingredient developing method. Hereinafter, the proportion of the toner and the carrier will be referred to as the toner density.

To maintain the quality of the printing image, it is required to control the toner density accurately. The toner density can be controlled to maintain the proportion of the toner and the carrier constantly. Several methods have been used to control the toner density. For example, a method of compensating for the amount of the toner as much as a change of the toner density which is determined using a signal of a toner sensor in a CPU of the image recording apparatus, is used to control the toner density.

FIG. 1 is a block diagram showing a device controlling the toner density. As shown in FIG. 1, a controller (CPU) 10 calculates a value for controlling a toner supply motor by detecting a variation of the toner density in accordance with a signal input from a toner sensor 20 and controls a supply amount of the toner by driving a toner supply motor driving unit 40 in response to the toner supply motor controlling value.

The toner supply motor controlling value is calculated at the controller 10 by using a difference between a toner density set-up value set up to improve the printing quality and a toner density detection value actually detected by the toner sensor 20. The controller 10 calculates the toner supply motor controlling value to meet the set up toner density and controls the supply amount of the toner by driving the toner supply motor driving unit 40 in response to the toner supply motor controlling value. The toner supply motor controlling value can be set up when the toner supply motor driving unit 40 is turned on or a voltage is supplied to the toner supply motor. The toner supply motor controlling value is calculated by an operational constant of the toner density set-up value stored in a memory 30 when the image recording apparatus is manufactured, and by the toner density detection value input from the toner sensor 20.

FIG. 2 is a flow chart showing a conventional method of controlling the toner density. As shown in FIG. 2, the controller 10 reads the operational constant of the toner density set-up value stored in the memory 30 and a toner controlling value in operation S10. Then, the controller 10 reads the toner density detection value in operation S20, and calculates a difference 'e' between the toner density set-up value read in the operation S10 and the toner density detection value read in the operation S20 in operation S30. Next, the controller 10 calculates the toner supply motor controlling value 'U' by using the operational constant read in the operation S10 and the difference 'e' of the toner density set-up value and the toner density detection value calculated in the operation S30 in operation S40. The controller 10 drives the toner supply motor according to the toner supply motor controlling value 'U' in operation S50. Each of the above operations S30, S40, S50 is repeated (see operation S60) after returning to the operation S20 until a printing operation is completed. The above conventional method controls the toner density by considering only the toner density detection value of the toner sensor and the operational constant.

The toner density should be changed in accordance with a consumed amount of the toner for a predetermined duration, and the consumed amount of the toner should be changed in accordance with printing information (data) about the printing image. When the printing information is a 5% coverage of a sheet of paper, a ratio of the number of dots of the printing information and the number of the entire dots that is printable on one page of the sheet is approximately 5%. Therefore, when the printing information is the 5% coverage, it can be said that the amount of the toner used for printing the printing image on the page of the sheet is approximately 5%. When the printing information is a 100% coverage, the page of the sheet would be printed all black. When a high density background color is used in the printing information, the printing coverage would be 50 to 70%.

In a printing operation for a printing object that requires relatively less printing coverage, there is a narrow difference between the toner density set-up value and the toner density detection value due to relatively small consumption of the toner. For a printing object that requires a wide printing coverage, however, the difference between the toner density set-up value and the toner density detection value becomes wider. For example, when documents including a small amount of letters and documents including a dark colored photograph are printed in turn, a variation of the printing coverage becomes greater. As the variation of the printing coverage increases, there is a great change in the toner supply. Further, if the supply amount of the toner increases more than the toner density set-up value, the toner is scattered. There is a wide difference in the toner consumption per unit time between a case where the toner consumption is 5% and another case where the printing object has a density almost black. Accordingly, there needs to be control of the printing operation of compensating for the difference.

However, the conventional toner density controlling apparatus and method uses a regular operational constant stored in the memory when calculating the toner supply motor (amount) controlling value. In other words, the toner supply motor controlling value is decided by considering only the toner density detection value detected by the toner sensor to the change of the consumed amount of the toner. Therefore, a period of time is required to adjust to the toner density set-up value, and there is a difficulty in controlling the toner density accurately since the toner amount is controlled with only the toner density detection value detected by the toner sensor without considering the printing coverage of the page of the sheet according to the printing information of the printing object.

SUMMARY OF THE INVENTION

The present invention has been made to overcome the above and other problems of the prior art. Accordingly, it is the object of the present invention to provide an apparatus and a method capable of controlling a toner density accurately in accordance with printing data.

Additional objects and advantageous of the invention will be set forth in part in the description which follows and, in part, will be obvious from the description, or may be learned by practice of the invention.

A toner density controlling apparatus according to an embodiment of the present invention to accomplish the above and other objects includes a memory to store a toner density set-up value and having an operational constant table having an operational constant (toner supply amount controlling value operating constant) corresponding to an amount of dots forming an image corresponding to printing data, a toner sensor detecting a toner density, a toner supply amount controlling unit, and a CPU deciding the operational constant in response to a signal of the printing data by using the operational constant table, calculating a controlling value of the toner supply amount controlling unit by using the operational constant, a toner density detection value output from the toner sensor, and the toner density set-up value stored in the memory, and controlling the toner supply amount controlling unit in response to the calculated controlling value.

A toner density controlling method to accomplish the above and other objects of the present invention controls the toner density by calculating the toner supply amount controlling value in response to the toner density set-up value and the toner density detection value by the toner sensor. The controlling value is calculated by changing a toner supply amount controlling value in response to the operational constant by an amount of toner required to print the image corresponding to the printing data.

The toner density controlling method according to another embodiment of the present invention includes reading the operational constant from the operational constant table corresponding to an amount of dots forming the image corresponding to the printing data, reading the toner density detection value detected by the toner sensor, deciding (selecting) the operational constant by receiving the signal in response to an amount of the printing data, calculating the toner supply amount controlling value by using the operational constant decided in the above operation, the toner density set-up value, and the toner density detection value, and driving the toner supply amount controlling unit in response to the toner supply amount controlling value calculated in the above operation.

The above operational constant table includes the operational constant and a toner supply amount controlling value operational expression set up by experiments in order to determine a consumption rate of the toner consumed in accordance with the amount of the dots to be printed to form the image corresponding to the printing data. The toner supply amount controlling value is obtained by calculating the amount of the dots constituting the printing data and deciding the toner supply amount controlling value operational expression in response to the amount of the dots and the operational constant of the operational constant table.

The toner supply amount controlling value is calculated by using an equation $U=K_P e+K_I edt+K_D de/dt$. Here, 'e' is a difference between the toner density set-up value and the toner density detection value, and $K_P$, $K_I$, and $K_D$ are the operational constants decided by using the operational constant table. The toner supply amount controlling value 'U' is a period of time during which an electric current flows to a toner supply motor performing a printing operation.

BRIEF DESCRIPTION OF THE DRAWINGS

The above-mentioned object and the feature of the present invention will be more apparent and more readily appreciated from the following description of the preferred embodiments, taken in conjunction with the accompanying drawings of which.

DETAILED DESCRIPTION OF THE PREFERRED EMBODIMENTS

Figure 1:
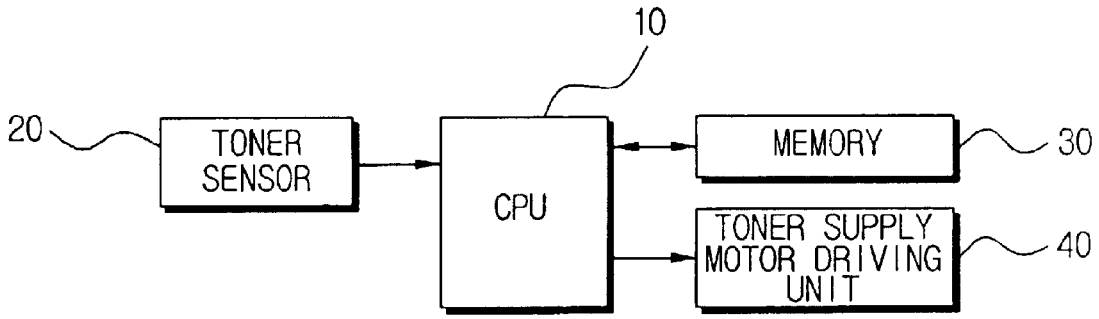
FIG. 1 (PRIOR ART)
FIG. 1 is a block diagram showing a conventional toner density controlling apparatus.
Figure 2:
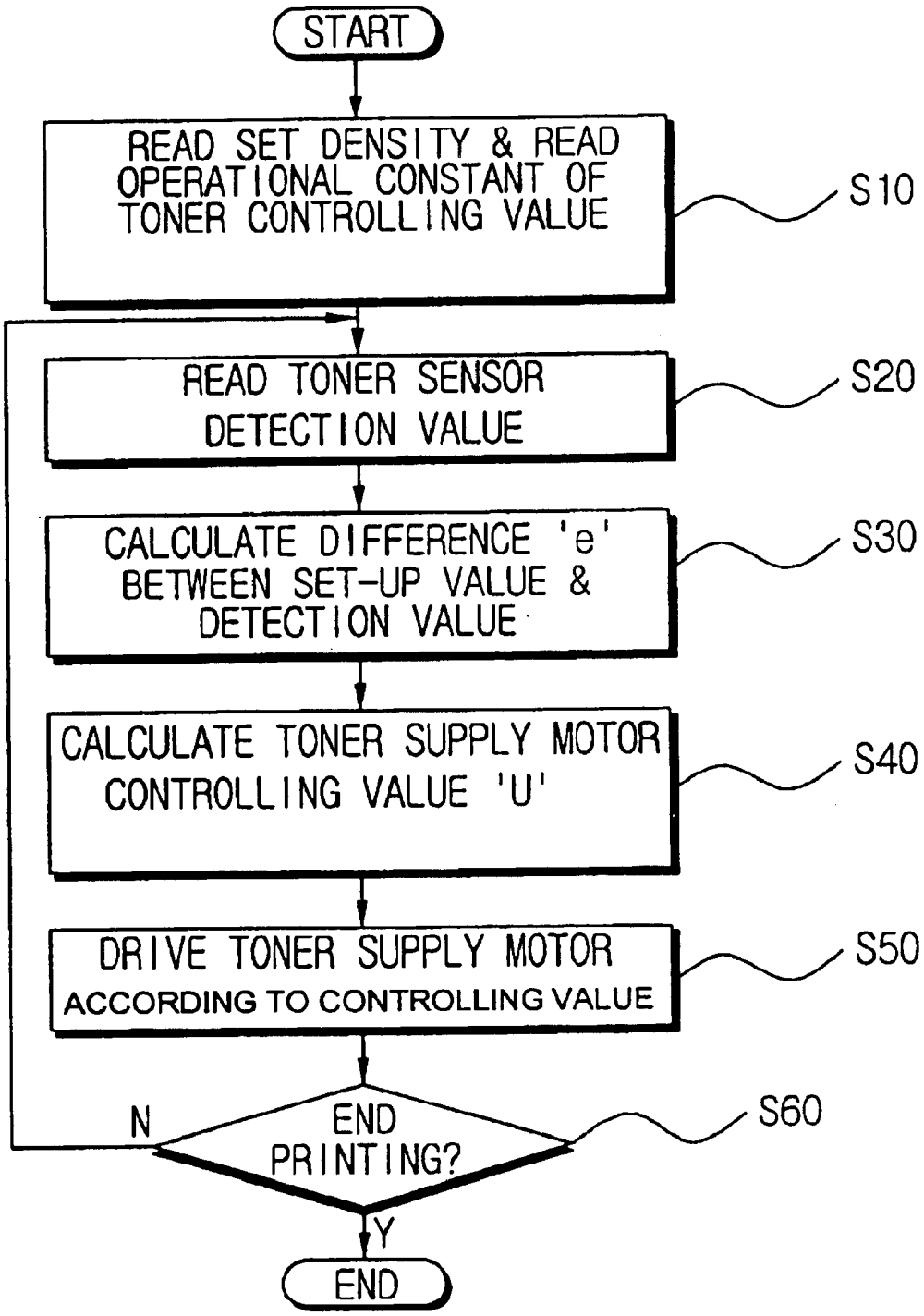
FIG.2 (PRIOR ART)
FIG. 2 is a flow chart showing a conventional toner density controlling method.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Hereinbelow, embodiments of the present invention will be described in greater detail by referring to the appended drawings.

Figure 3:
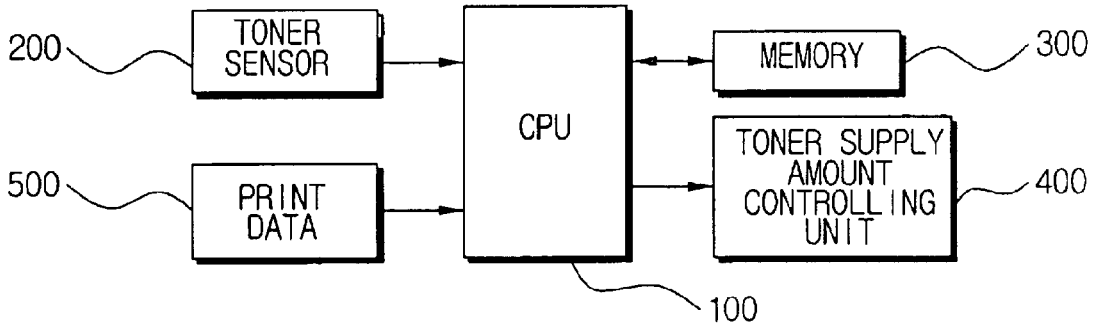
FIG. 3 is a block diagram showing a toner density controlling apparatus according to an embodiment of the present invention.

FIG. 3 is a block diagram schematically showing a toner density controlling apparatus according to an embodiment of the present invention. As shown in FIG. 3, the toner density controlling apparatus includes a toner sensor 200 generating a signal corresponding to a toner density detection value, a memory 300 storing a toner density set-up value and an operational constant data table having an operational constant set up by experiments to be used for controlling a supply amount of toner corresponding to printing data, an input unit 500 inputting the printing data, a toner supply amount controlling unit 400 supplying the toner to a developing unit in response to a control signal, and a CPU 100 determining the operational constant by using the operational constant data table, and controlling the toner supply amount controlling unit 400 by using the control signal generated from the operational constant, the toner density detection value, and the toner density set-up value.

The toner sensor 200 outputs the signal corresponding to the toner density detection value by detecting a toner density which is a proportion of a carrier and the toner changing as the toner is consumed to print an image corresponding to the printing data. The memory 300 stores the toner density as the toner density set-up value to maintain an appropriate printing quality and also stores an operational expression in the operational constant data table to calculate a toner supply amount controlling value. The operational constant is set up by experiments to be suitable for changing the supply amount of toner in response to an amount of dots of the image corresponding to the printing data.

The data input unit 500 inputs the printing data stored in a memory device (not shown) of an image recording apparatus into the CPU 100. The toner supply amount controlling unit 400 is controlled by the control signal of the CPU 100 and supplies the toner to the developing unit of the image recording apparatus. It is possible that the toner supply amount controlling unit 400 is a toner supply motor driving unit.

The CPU 100 converts the input printing data to a raster image to be suitable for printing, and calculates the amount of the dots in a printing region (area) of the raster image by counting the number of the dots corresponding to the raster image to be printed. Moreover, the CPU 100 determines the operational constant corresponding to the amount of the dots to be printed by using the operational constant data table. The operational constant is a constant to be substituted as an operational expression to calculate a toner supply amount controlling value 'U' corresponding to the control signal.

To control the toner supply amount controlling value 'U,' several methods (operational expressions) can be used in the toner density controlling apparatus. A proportional expression, such as $U=K_P e$, can be used in a case of a proportional control to calculate the toner supply amount controlling value in proportion to a difference between the toner density detection value of the toner sensor 200 and the toner density set-up value. '$K_P$' is a proportional constant, and 'e' is the difference between the toner density detection value and the toner density set-up value. Besides the proportional expression, a controlling value operational expression $U=K_P e+K_I\ edt$ can be used in a case of a proportional and integral constants (PI) control where '$K_I$' is the integral constant. In addition, to control more accurately, a proportional, integral, and differential (PID) controlling expression $U=K_P e+K_I\ edt+K_D de/dt$ can be used. '$K_I$' is the integral constant, '$K_D$' is a differential constant, and the operational constants $K_P$, $K_I$, and $K_D$ are stored in the memory 300 as appropriate values set up by experiments according to the amount of the dots. The CPU 100 calculates the toner supply amount controlling value by using the above operational expression and respective corresponding values, and controls the supply amount of the toner by controlling the toner supply amount controlling unit 400 in accordance with the toner supply amount controlling value.

Figure 4:
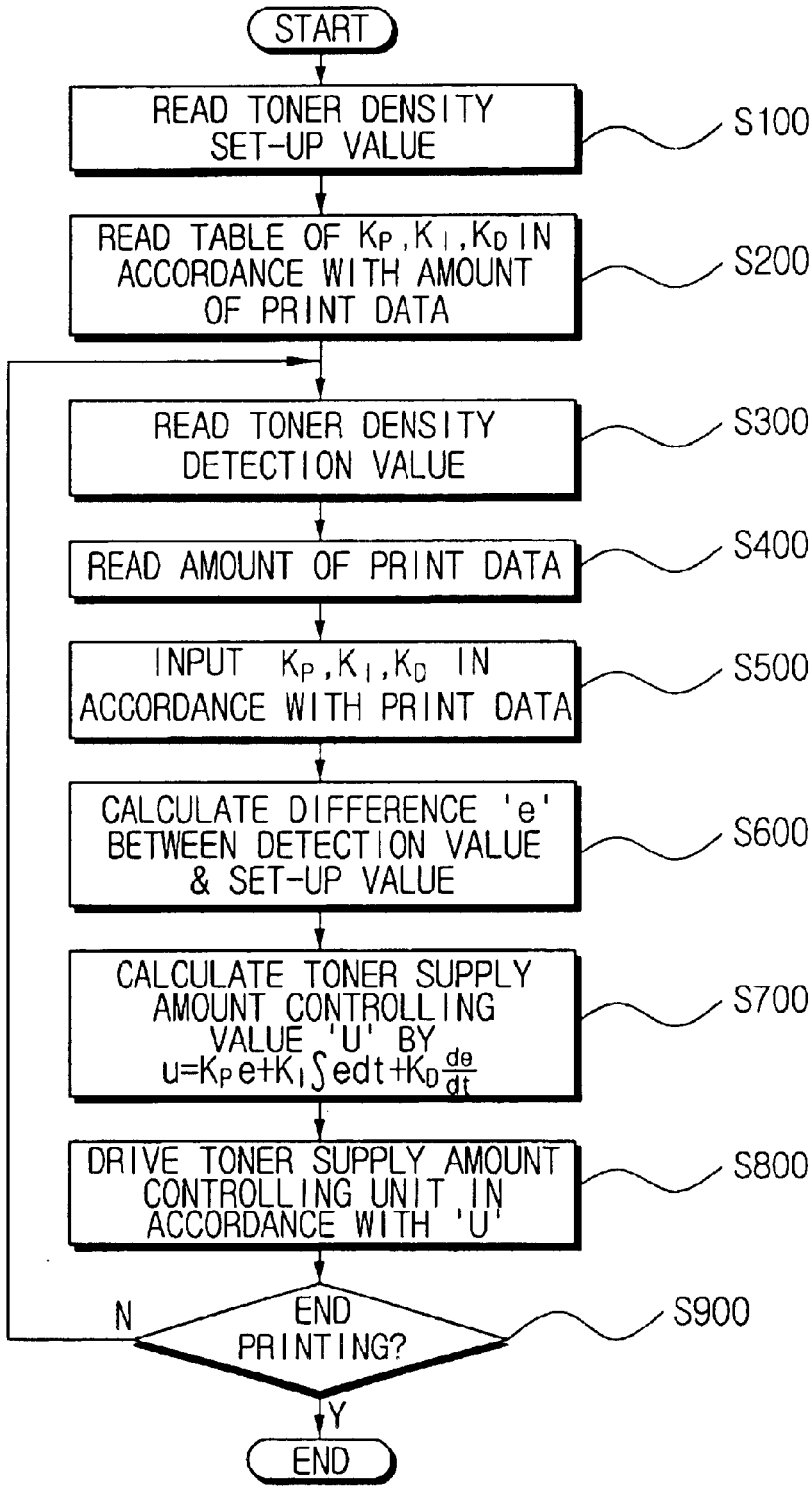
FIG. 4 is a flow chart showing a toner density controlling method according to another embodiment of the present invention.

FIG. 4 shows a toner density controlling method in the toner density controlling apparatus having the above structure according to another embodiment of the present invention. The toner density controlling method will be described hereinbelow by referring to FIG. 4.

The CPU 100 controlling a function of the image recording apparatus reads the toner density set-up value stored in the memory 300 and the operational constants of the operational constant data table in response to the amount of the dots of the printing data in operation S100 and operation S200, respectively. After that, the CPU 100 reads the toner density detection value output from the toner sensor 200 in operation S300. Next, the CPU 100 sets up a printing coverage by using the printing data, which has been converted into the raster image to be printed, in order to count the number of the dots in the printing area in operation S400. Then, the CPU 100 determines the operational constant corresponding to the set-up printing coverage by using the operational constant table in operation S500. That is, the operational constant is selected and input into the CPU in response to the set-up printing coverage of the printing data in operation 500. In addition, the CPU 100 calculates a difference between the toner density detection value of the toner sensor 200 and the toner density set-up value in operation S600. After that, the CPU 100 calculates the toner supply amount controlling value by using the operational constants $K_P$, $K_I$, and $K_D$ calculated in the above operations S500 and S600 and the difference between the toner density detection value and the toner density set-up value of the toner density in operation S700, and drives the toner supply amount controlling unit 40 in accordance with the calculated toner supply amount controlling value in operation S800.

In operation S900 it is determined whether a printing operation is completed. When printing is not completed, then the CPU 100 returns to the operation S300 and repeats the operations from S300 to S800, and controls the toner density during the printing.

The printing coverage is not always regular but varies since the printing data may have a little letter or a background of dark color. The printing coverage means a rate of a total amount of the dots of the printing data to the total amount of the dots in the entire printing area (the number of the dots to be printed in a portion of the printing area/the number of the dots covering all portions of the printing area). When the printing coverage becomes great, the consumed amount of the toner also becomes great, thus the difference 'e' between the toner density set-up value and the toner density detection value of the toner density is great in accordance with the printing coverage during printing. When the printing coverage is little, the difference 'e' is also little.

The printing coverage of the printing data can be calculated by counting the number of the dots in the printing area of the printing data that has been rastered for printing. The printing area can be an entire page or when one page is divided into several bands and rastered, one band becomes a standard for counting the number of the dots of the band, and thus the printing coverage can be calculated.

To improve the printing quality, the difference 'e' between the toner density set-up value and the detection value should be minimized. Since the consumed amount of the toner is different, the difference 'e' of the printing coverage causes a time consuming operation since there is a lapse of time between a first response time consumed to minimize the difference 'e' by controlling the toner supply amount and a second response time consumed to receive a result of the controlling of the toner supply amount in the prior art. However, according to the present invention, as the toner supply amount controlling value is calculated by using an appropriate operational constant in response to the printing coverage, the toner density can be accurately controlled in response to the printing data.

According to the present invention, even when a printing data has a difference in the consumed amount of the toner per a unit time, the toner supply amount is controlled by compensating for the difference according to the printing coverage. Therefore, the toner density can be accurately controlled. In addition, when there is a great change in the consumed amount of the toner, the toner amount is appropriately controlled. Thus, the problem that the toner is scattered due to over supply of the toner can be prevented.

Although the preferred embodiment of the present invention has been described, it will be understood by those skilled in the art that the present invention should not be limited to the described preferred embodiment, but various changes and modifications can be made in this embodiment without departing from the principles and sprit of the invention, the scope of which is defined in the claims and their equivalents. Accordingly, the scope of the present invention is not limited within the described range but the following claims.

What is claimed is:

1. A toner density controlling apparatus comprising:

a memory storing a toner density set-up value and an operational constant table having an operational constant corresponding to an amount of dots forming an image representing printing data;

a toner sensor detecting a toner density and generating a toner density detecting value;

a toner supply amount controlling unit; and a CPU determining the operational constant in response to a signal of the printing data using the operational constant table, calculating a toner supply amount controlling value of the toner supply amount controlling unit by using the operational constant, the toner density detection value output from the toner sensor, and the toner density set-up value stored in the memory, and controlling the toner supply amount controlling unit in response to the calculated toner supply amount controlling value.

2. A toner density controlling method comprising:

controlling a toner density by calculating a toner supply amount controlling value in accordance with a toner density set-up value and a toner density detection value by a toner sensor, wherein the controlling value is calculated by changing a toner supply amount controlling value operational constant from among at least one stored operational constant in response to an amount of toner corresponding to printing data.

3. A toner density controlling method comprising:

reading a toner supply amount controlling value operational constant table having an operational constant corresponding to an amount of dots corresponding to printing data;

reading a toner density detection value detected by a toner sensor;

determining the operational constant by receiving a signal in response to an amount of the printing data;

calculating a toner supply amount controlling value by using the operational constant, a toner density set-up value, and the toner density detection value; and driving a toner supply amount controlling unit in response to the toner supply amount controlling value.

4. The toner density controlling method of claim 3, wherein the reading of the operational constant table comprises:

inserting the operation constant in a toner supply amount controlling value operational expression corresponding to a consumption rate of the toner consumed in accordance with an amount of the dots to be printed.

5. The toner density controlling method of claim 3, wherein the determining of the operational constant comprises:

calculating the amount of the dots according to the printing data; and calculating the operational constant using the toner supply amount controlling operational constant table in response to the calculated amount of the dots.

6. The toner density controlling method of claim 3, wherein the calculating of the toner supply amount controlling value comprises:

calculating the toner supply amount controlling value using an equation $U=K_P e+K_I \int e dt+K_D de/dt$ where e is a difference between the toner density set-up value and the toner density detection value, and $K_P$, $K_I$, and $K_D$ are the operational constants.

7. The toner density controlling method of claim 6, wherein the toner supply amount controlling value comprises:

a period of time when an electric current flows to a toner supply motor controlling the toner supply amount controlling unit.

8. A toner density controlling method in an image forming apparatus having a toner supply amount controlling unit, a developing unit, the method comprising:

generating a toner supply amount controlling value in accordance with printing data, toner density data, and an operational constant from a stored table of operational constants; and controlling the toner supply amount controlling unit to supply toner to the developing unit in response to the toner supply amount controlling value.

9. The toner density controlling method of claim 8, wherein the generating of the toner supply amount controlling value comprises:

generating a signal representing a number of dots of an image representing the printing data; and generating the toner supply amount controlling value in accordance with the signal.

10. The toner density controlling method of claim 8, wherein the generating of the toner supply amount controlling value comprises:

determining the operation constant representing an amount of dots of the print data;

reading a toner density detection value from the developing unit;

reading a toner density set-up value; and calculating the toner supply amount controlling value from the operation constant, the toner density detection value, and the toner density set-up value.

11. The toner density controlling method of claim 10, wherein the generating of the toner supply amount controlling value comprises:

calculating a difference between the toner density set-up value and the toner density detection value; and calculating the toner supply amount controlling value using the difference and the operational value.

12. A toner density controlling method in an image forming apparatus having a toner supply amount controlling unit, a developing unit, comprising:

generating a toner supply amount controlling value in accordance with printing data; and controlling the toner supply amount controlling unit to supply toner to the developing unit in response to the toner supply amount controlling value, wherein the printing data comprises first data, which has been printed, and second data which is to be printed, and wherein the generating of the toner supply amount controlling value comprises:

generating a signal representing a variation of the first and second printing data; and generating the toner supply amount controlling value in accordance with the signal.

13. A toner density controlling method in an image forming apparatus having a toner supply amount controlling unit, a development unit, comprising:

generating a toner supply amount controlling value in accordance with printing data: and controlling the toner supply amount controlling unit to supply toner to the developing unit in response to the toner supply amount controlling value, wherein the generating of the toner supply amount controlling value comprises:

determining an operation constant representing an amount of dots of the print data;

reading a toner density detection value from the developing unit;

reading a toner density set-up value;

calculating the toner supply amount controlling value from the operation constant, the toner density detection value, and the toner density set-up value;

calculating an integration value of the difference during a period of time; and calculating the toner supply amount controlling value using the integral value and the operational value.

14. A toner density controlling method in an image forming apparatus having a toner supply amount controlling unit, a development unit, comprising:

generating a toner supply amount controlling value in accordance with printing data: and controlling the toner supply amount controlling unit to supply toner to the developing unit in response to the toner supply amount controlling value, wherein the generating of the toner supply amount controlling value comprises:

determining an operation constant representing an amount of dots of the print data;

reading a toner density detection value from the developing unit; reading a toner density set-up value;

calculating the toner supply amount controlling value from the operation constant, the toner density detection value, and the toner density set-up value;

calculating a differentiation value of the difference by a predetermined time; and calculating the toner supply amount controlling value using the differential value and the operational value.

15. A toner density controlling apparatus having a toner supply amount controlling unit in an image forming apparatus, comprising:

a memory storing an operational constant corresponding to an amount of dots forming an image representing printing data; and a controller controlling the toner supply amount controlling unit in accordance with the operational constant.

16. The toner density controlling apparatus of claim 15, further comprising a developing unit and a toner sensor detecting a toner density of the developing unit and generating a toner density detecting value, and the controller controls the toner supply amount controlling unit in accordance with the toner density detecting value.

17. The toner density controlling apparatus of claim 16, wherein the memory stores a toner density set-up value, and the controller controls the toner supply amount controlling unit in accordance with the toner density set-up value.

18. The toner density controlling apparatus of claim 16, wherein the controller generates a signal representing a number of dots of an image representing the printing data from the operation constant and generates the toner supply amount controlling value in accordance with the signal.

19. The toner density controlling apparatus of claim 16, wherein the printing data comprises first data, which has been printed, and second data which is to be printed, and the controller generates a signal representing a variation of the first and second printing data and controls the toner supply amount controlling value in accordance with the signal.

20. The toner density controlling apparatus of claim 16, wherein the controller calculates a ratio between a printing area representing the printing data and a blank area of a sheet of paper and generates the toner supply amount controlling value in accordance with the ratio.

* * * * *